US011566422B2

(12) United States Patent
Huang et al.

(10) Patent No.: US 11,566,422 B2
(45) Date of Patent: Jan. 31, 2023

(54) STRUCTURAL JOINT AND SEALING ELEMENT FOR PANELS

(71) Applicant: MINIWIZ CO.,LTD., Taipei (TW)

(72) Inventors: Chian-Chi Huang, Taipei (TW); Tzu-Wei Liu, Taipei (TW); Jui-Ping Chen, Taipei (TW); Yu-Ying Yai, Taipei (TW); Yu-Tung Hsing, Taipei (TW); Pei-Yi Huang, Taipei (TW); Min-Wei Lin, Taipei (TW); Yi-Chun Chang, Taipei (TW); Ling-Hsiang Weng, Taipei (TW)

(73) Assignee: MINIWIZ CO., LTD., Taipei (TW)

( * ) Notice: Subject to any disclaimer, the term of this patent is extended or adjusted under 35 U.S.C. 154(b) by 0 days.

(21) Appl. No.: 17/170,964

(22) Filed: Feb. 9, 2021

(65) Prior Publication Data

US 2022/0251831 A1 Aug. 11, 2022

(51) Int. Cl.
*E04B 2/96* (2006.01)
*E04B 2/74* (2006.01)

(52) U.S. Cl.
CPC .... *E04B 2/7407* (2013.01); *E04B 2002/7461* (2013.01)

(58) Field of Classification Search
CPC ..... E04B 2/967; E04B 1/6112; E04B 2/96; E04B 2002/7461; E04B 2/7407
See application file for complete search history.

(56) References Cited

U.S. PATENT DOCUMENTS 1,278,343 A * 9/1918 Hester ..... E06B 1/363 52/204.57
3,340,663 A * 9/1967 Collard ..... E06B 1/02 52/775
3,688,460 A * 9/1972 Van Loghem ..... E04F 19/062 52/466

(Continued)

*Primary Examiner* — Brian E Glessner
*Assistant Examiner* — Daniel J Kenny

(57) ABSTRACT

Disclosed herein is a building assembly for assembling building panels. The building assembly includes a supporting member, a pair of a first sealing member, an elastically deformable gasket, and a second sealing member. The supporting member has a base, a channel disposed at the center of the base, and a pair of rails independently disposed next to the channel. The pair of a first sealing members independently includes a first base portion and two retention tongues independently extending outwardly from the first base portion. The elastically deformable gasket has a U- or V-shaped space in cross section and two flanges independently extending laterally from one edge of the U- or V-shaped space. The second sealing member has a second base portion and a rib disposed at the center of the second base portion. Further, the pair of the first sealing members are configured to engage with the supporting member, the elastically deformable gasket is configured to be snap-fitted into the channel of the supporting member, the second sealing member is configured to engage with the elastically deformable gasket via press-fitting the rib into the U- or V-shaped space of the elastically deformable gasket; and the engagement of the pair of the first sealing members with the supporting member creates a pair of pockets independently for receiving a construction panel therein.

5 Claims, 4 Drawing Sheets

(56) References Cited

U.S. PATENT DOCUMENTS

| | | | | | |
|---|---|---|---|---|---|
| 4,008,552 | A * | 2/1977 | Biebuyck | E06B 7/14 | 52/204.591 |
| 5,155,952 | A * | 10/1992 | Herwegh | E04B 1/6803 | 52/100 |
| 5,481,839 | A * | 1/1996 | Lang | E04B 2/967 | 52/235 |
| 5,678,383 | A * | 10/1997 | Danielewicz | E04D 3/06 | 52/235 |
| 8,578,671 | B2 * | 11/2013 | Labrecque | E04B 2/967 | 52/395 |
| 8,650,827 | B2 * | 2/2014 | Givoni | E04C 2/543 | 52/588.1 |
| 10,563,449 | B2 * | 2/2020 | McKenna | E06B 3/26 | |
| 2017/0298621 | A1 * | 10/2017 | Frederick | E04B 2/90 | |
| 2019/0078375 | A1 * | 3/2019 | McKenna | E06B 3/5409 | |
| 2022/0034081 | A1 * | 2/2022 | Birkelbach | E02D 29/16 | |

* cited by examiner

STRUCTURAL JOINT AND SEALING ELEMENT FOR PANELS

BACKGROUND OF THE INVENTION

1. Field of the Invention

The present invention relates to a building assembly, particularly to sealed building assembly for use in the construction of chambers, such as germ-free chambers or chambers in which a slight negative or positive pressure is generally present.

2. Description of Related Art

It is known for construction panels to be assembled by a variety of methods and assemblies. U.S. Publication No. 2015/0376899 illustrates one such method and assembly. However, a need exists for an improved assembling system for constructing chambers suitable for medical use, such as germ-free chambers and chambers having slightly negative pressure therein.

The present disclosure aims to provide a building assembly that may be easily and economically manufactured, and also easy to assemble, disassemble, or reassemble, further, the connected walls are air-sealed there between,

SUMMARY

The object of the present disclosure is to provide a building assembly for use in the construction of chambers, e.g., germ-free chambers or chambers in which a slight negative or positive pressure is generally present. The chambers can be easily assembled, disassembled and/or reassembled in case of an emergency.

Accordingly, the first aspect of the present disclosure is directed to a building assembly, which includes:

a supporting member comprising a base having a front and rear sides, a channel disposed on the front side of the base at the center thereof, and a pair of rails independently extending parallel and adjacent to the channel at its left and right sides;

a pair of a first sealing members independently comprising a first base portion having a front and rear sides, and two retention tongues independently extending outwardly from the rear side of the first base portion along the entire longitudinal length thereof;

an elastically deformable gasket having a U- or V-shaped space in cross section and two flanges independently extending laterally from one edge of the U- or V-shaped space; and a second sealing member comprising a second base portion having a front and rear sides, and a rib disposed on the rear side of the second base portion at the center along the longitudinal length thereof;

wherein, the pair of the first sealing members are configured to engage with the supporting member via press-fitting the two retention tongues of each of the first sealing member into each of the rails of the supporting member;

the elastically deformable gasket is configured to be snap-fitted into the channel of the supporting member;

the second sealing member is configured to engage with the elastically deformable gasket via press-fitting the rib into the U- or V-shaped space of the elastically deformable gasket; and the engagement of the pair of the sealing members with the supporting member creates a pair of pockets independently for receiving a construction panel therein.

According to preferred embodiments of the present disclosure, the second sealing member further includes first and second extensions respectively extending upwardly away from the rear side of the second base portion along the entire longitudinal length thereof.

According to alternative embodiments of the present disclosure, the supporting member further comprises a rectangular conduit formed on the rear side of the base.

According to preferred embodiments of the present disclosure, the first sealing member, the elastically deformable gasket and the second sealing member are independently made of a resilient material selected from the group consisting of polypropylene (PP), neoprene, thermoplastic elastomer (TPE), and a combination thereof.

Examples of the TPE suitable for use in the present disclosure include, but are not limited to, thermoplastic styrene (TPS), thermoplastic vulcanizate (TPV), thermoplastic polyurethane (TPU), thermoplastic polyether ester (TPEE), thermoplastic polyamide (TPA), and the like. Preferably, the first sealing member and the second sealing member are respectively made of TPV, while the elastically deformable gasket is made of PP.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present disclosure are illustrated below in conjunction with the accompanying drawings. However, it is to be understood that the descriptions and the accompanying drawings disclosed herein are merely illustrative and exemplary and not intended to limit the scope of the present disclosure.

1. The Present Building Assembly

Figure 1:
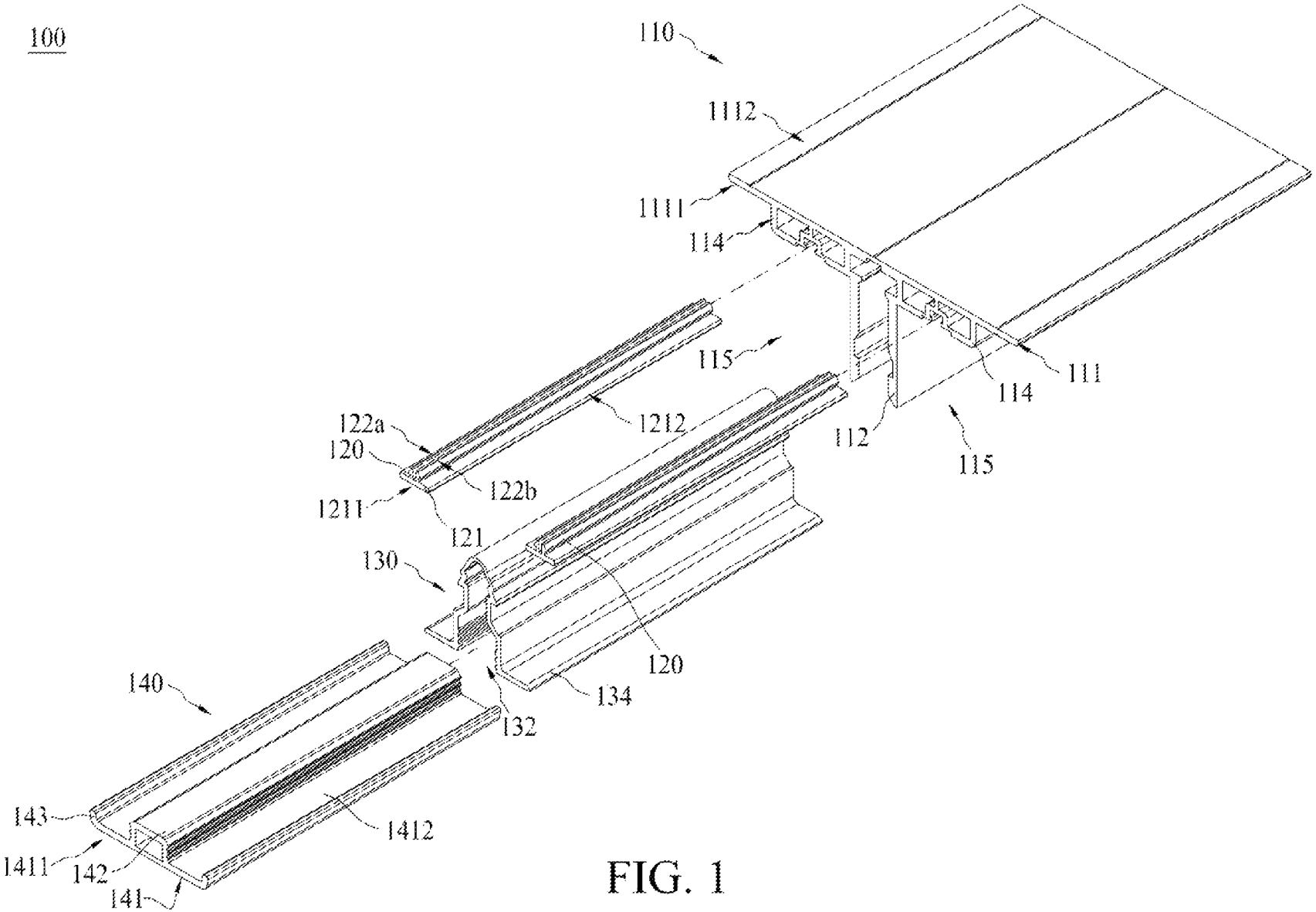
FIG. 1 is an exploded view of a building assembly 100 in accordance with one preferred embodiment of the present disclosure.
Figure 2:
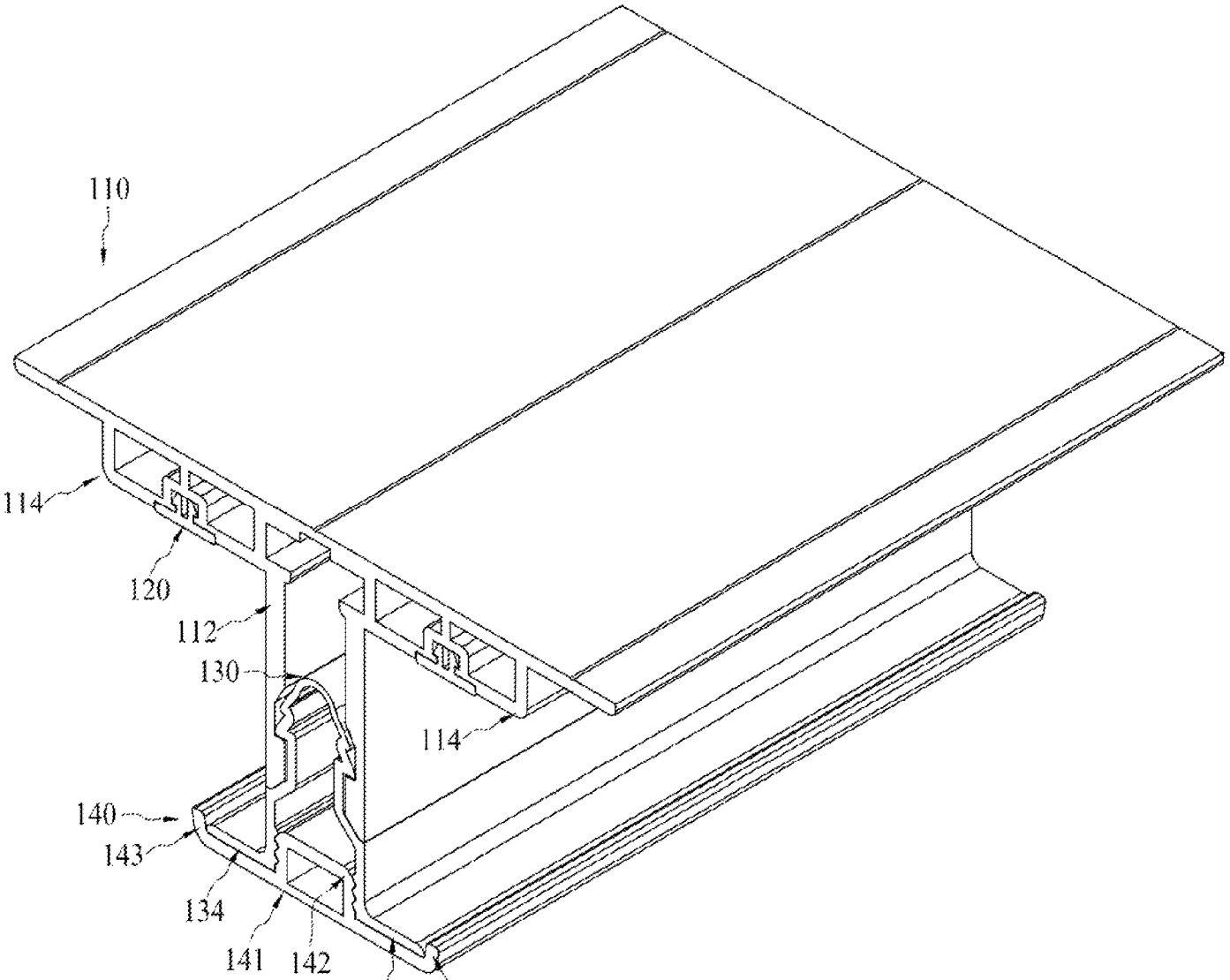
FIG. 2 is a perspective view of the building assembly 100 of FIG. 1 after assembling.
Figure 3:
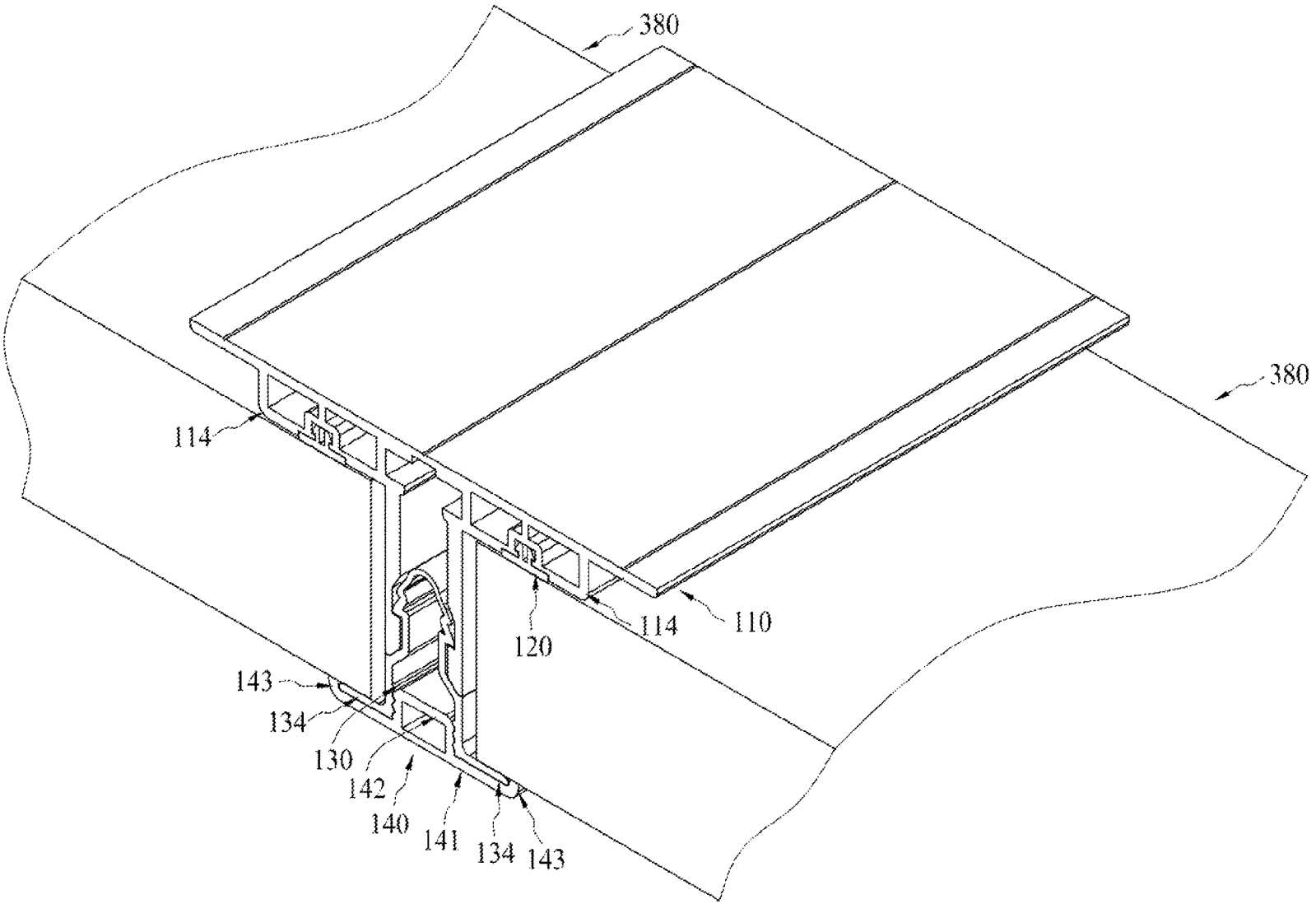
FIG. 3 is a sectional view of an assembly including two wall panels 380 assembled with the aid of the building assembly of FIG. 1.

Referring more particularly to FIGS. 1 to 3, in which FIG. 1 is an exploded view of the present building assembly 100; FIG. 2 is a perspective view of the building assembly 100 of FIG. 1 after assembling; FIG. 3 is a sectional view of an assembly including two wall panels 380 assembled with the aid of the building assembly of FIG. 1.

The building assembly 100 in this embodiment comprises a supporting member 110, a pair of a first sealing members 120, an elastically deformable gasket 130, and a second sealing member 140. The supporting member 110 includes in its structure, a base 111 having a front side 1111 and a rear side 1112; a channel 112 formed at the center of the front side 1111 and extends longitudinally alone the entire length of the base 111; and two rails 114 respectively running parallel adjacent to the channel 112 at its left and right sides and extends longitudinally along the entire length of the base 111.

A pair of a first sealing members 120 are provided for engaging the two rails 114, respectively. Each sealing member 120 comprises a base portion 121 having a front and rear sides 1211, 1212; and two mirror-image retention tongues 122*a*, 122*b* independently extending outwardly from the rear side 1212 of the base portion 121 along the entire longitudinal length thereof. During assembly, each sealing member 120 is press-fitted or snap-fitted into one of the two rails 120 of the supporting member 110 to provide a sealed surface, and also creates a pocket 115 for subsequently holding a construction panel (not depicted in FIGS. 1 and 2) and the like therein. Specifically, the pocket 115 refers to the space collectively defined by one of the rails 114 and one of the channel walls. Accordingly, two construction panels 380 (e.g., wall panels or ceiling panels) may be respectively placed into the two pockets 115 and held against the two rails 114 and the channel 112 (FIG. 3).

To help holding the two construction panels 380 in the two pockets 115, an elastically deformable gasket 130 may be subsequently press-fitted or snap-fitted into the channel 112 of the supporting member 110. The elastically deformable gasket 130 has a U- or V-shaped space 132 in cross section, and two flanges 134 independently extending laterally from one edge of the U- or V-shaped space 132. Once the elastically deformable gasket 130 is press-fitted into the channel 112, the two flanges 134 will be pressed against the two construction panels 380 respectively held in the two pockets 115 (FIG. 3). Finally, to complete the assembling, a second sealing member 140 is press-fitted or snap-fitted into the U- or V-shaped space 132, so as to hold the elastically deformable gasket 130 in place while creating a tight-seal therebetween. Structurally, the second sealing member 140 comprises a second base portion 141, a rib 142, and two extensions 143. The second base portion 141 has a front side 1411 and a rear side 1412. The rib 142 is formed on the rear side 1412 of the second base portion 141 at its center and extends along the entire longitudinal length thereof. Additionally or alternatively, the rib 142 may be hollow inside. In this embodiment, the rib 142 is hollow and rectangular in cross section and is sized to fit into the U- or V-shaped space 132 of the elastically deformable gasket 130. Two extensions 143 independently extend perpendicularly away from the rear side 1412 of the second base portion 141, and are configured to further hold the elastically deformable gasket 130 in place via clinging on to the respective edges of the two flanges 134.

Note that in the present disclosure, the first sealing members 120, the elastically deformable gasket 130, as well as the second sealing member 140 may be independently made of a resilient or elastic material, such as polypropylene (PP), neoprene, thermoplastic elastomer (TPE), and the like. Examples of TPE material suitable for use in the present disclosure include, but are not limited to, thermoplastic styrene (TPS), thermoplastic vulcanizate (TPV), thermoplastic polyurethane (TPU), thermoplastic polyether ester (TPEE), thermoplastic polyamide (TPA) and the like. According to preferred embodiment, the first sealing members 120 and the second sealing member 140 are respectively made of TPV, while the elastically deformable gasket 130 is made of PP.

2. Alternative Design of the Present Building Assembly for Use in the Presence of a Construction Beam Reference is now made to FIG. 4, which is an alternative design of the present building assembly 400 suitable for use in the case when a construction beam is present. The components of the building assembly 400 in this embodiment are in general same as those in the building assembly 100 depicted in FIG. 1, except the supporting member 410 in this embodiment is structurally different from that in FIG. 1.

Figure 4:
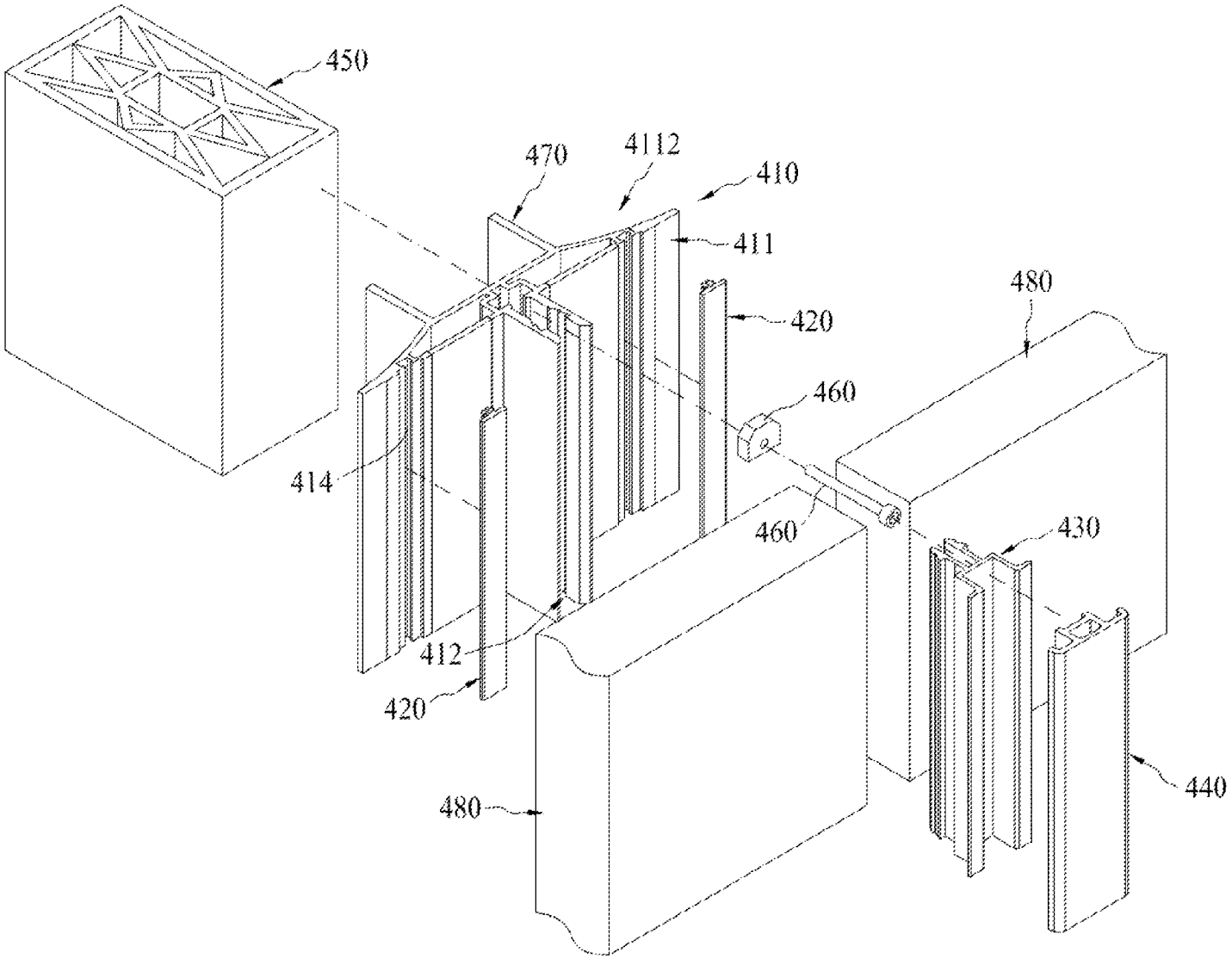
FIG. 4 is a perspective view of a building assembly 400 for assembling wall panels in the presence of a construction beam 450 in according to an alternative embodiment of the present disclosure.

As most of the components and pars in the building assembly 400 are same as those in the building assembly 100, thus the same components and parts are denoted by the common numbering elements. For example, the supporting member in FIG. 1 is 110, while in FIG. 4 is 410; the elastically deformable gasket in FIG. 1 is 130, while in FIG. 4 is 430 and so on.

The supporting member 410 in this embodiment differs from that in FIG. 1 in that it further includes a structure for receiving a building beam (e.g., a ceiling beam) therein. As depicted in FIG. 4, the supporting member 410 further includes a rectangular conduit 470 formed on the rear side 4112 of the base 411, in which the rectangular conduit 470 is sized to receive a building beam 450 therein.

In order to assemble a germ-free chamber or a chamber having a slight negative pressure, the supporting member 410 may be first threadedly secured to the beam 450 by screws 460 or any suitable nut-bolt structure, then the pair of the first sealing members 420 are snap-fitted into the two rails 414 thereby forming two pockets 415 for respectively receiving two wall panels 480 therein. Note that the two pockets 415 are not visible from FIG. 4, as they are occupied by the two wall panels 480. Then, the elastically deformable gasket 430, which has a U-shaped in cross section, is snap-fitted into the channel 412, followed by snap-fitting the second sealing member 440 into the U-shaped space of the elastically deformable gasket 430, thereby completing the assemble of two wall panels 480 using the building assembly 400. Additional wall panels, ceiling panels or any desired panels (e.g., panels that contain profile of sockets, air conduits and etc.) may be added next to the two assembled panels 480 using the building assembly 100 described above.

Each of the components discussed above in FIGS. 1 to 4 may be manufactured by methods such as casting, stamping, injection molding, extrusion molding and the like, as would be apparent to a skilled artisan; preferably, by extrusion molding. Additionally or alternatively, each of the components discussed above in FIGS. 1 to 4 may be milled, sanded or likewise manufactured for a smooth or coarse surface finish. Additionally or alternatively, except for the indicated parts (e.g., the retention tongues, the elastically deformable gasket, and the rib) each of the components discussed above in FIGS. 1 to 4 may be made of a plastic, ceramic, metal and other equivalent material, as would be apparent to a skilled artisan.

It will be understood that the above description of embodiments is given by way of example only and that various modifications may be made by those with ordinary skill in the art. The above specification, examples and data provide a complete description of the structure and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of the present disclosure.

What is claimed is:

1. A building assembly consisting of, a supporting member comprising a base having front and rear sides, a channel disposed on the front side of the base at the center thereof, a pair of rails disposed next to the channel, and an open rectangular conduit formed on the rear side of the base, each of the channel, the pair of rails and the open rectangular conduit extends along the entire length of the base;

a pair of first sealing members, in which each of the pair of first sealing members comprises a first base portion having front and rear sides, and two retention tongues respectively extending outwardly from the rear side of the first base portion along the entire length thereof;

an elastically deformable gasket having a U- or V-shaped space in cross section and two flanges, each of the two flanges extending laterally from one of the two edges of the U- or V-shaped space; and a second sealing member comprising a second base portion having front and rear sides, a rib disposed on the rear side of the second base portion at the center along the length thereof, and first and second extensions respectively extending upwardly away from the rear side of the second base portion along the entire length thereof;

wherein, the open rectangular conduit formed on the rear side of the base of the supporting member is configured to receive a building beam therein;

the pair of the first sealing members are configured to engage with the supporting member via press-fitting the two retention tongues of each sealing member into each of the pair of rails of the supporting member;

the elastically deformable gasket is configured to be snap-fitted into the channel of the supporting member;

the second sealing member is configured to engage with the elastically deformable gasket via press-fitting the rib into the U- or V-shaped space of the elastically deformable gasket; and the engagement of the pair of the first sealing members with the supporting member creates a pair of pockets independently for receiving a construction panel therein.

2. The building assembly of claim 1, wherein the second sealing member further comprises first and second extensions respectively extending upwardly away from the rear side of the second base portion along the entire length thereof.

3. The building assembly of claim 1, wherein each of the first sealing member, the elastically deformable gasket and the second sealing member is made of a resilient material selected from the group consisting of polypropylene (PP), neoprene, thermoplastic elastomer (TPE), and a combination thereof.

4. The building assembly of claim 3, wherein the TPE is selected from the group consisting of thermoplastic styrene (TPS), thermoplastic vulcanizate (TPV), thermoplastic polyurethane (TPU), thermoplastic polyether ester (TPEE), and thermoplastic polyamide (TPA).

5. The building assembly of claim 4, wherein the first sealing member and the second sealing member are made of TPV, while the elastically deformable gasket is made of PP.

* * * * *